US006907865B1

(12) United States Patent
Hanby

(10) Patent No.: US 6,907,865 B1
(45) Date of Patent: Jun. 21, 2005

(54) FUEL TANK ASSEMBLY

(75) Inventor: Jeffrey D. Hanby, Cass City, MI (US)

(73) Assignee: Walbro Engine Management, L.L.C., Tuscon, AZ (US)

( * ) Notice: Subject to any disclaimer, the term of this patent is extended or adjusted under 35 U.S.C. 154(b) by 0 days.

(21) Appl. No.: 10/634,258

(22) Filed: Aug. 5, 2003

(51) Int. Cl.[7] ..... F02M 37/02
(52) U.S. Cl. ..... 123/509
(58) Field of Search ..... 123/509, 510, 123/511; 137/565.17; 280/835

(56) References Cited

U.S. PATENT DOCUMENTS 4,871,041 A * 10/1989 Saito et al. ..... 180/219
4,972,875 A * 11/1990 Beer et al. ..... 137/590
5,249,594 A * 10/1993 Kizer ..... 137/15.08
5,272,918 A * 12/1993 Gaston et al. ..... 73/290 R
5,636,616 A * 6/1997 Okane et al. ..... 123/514
5,785,032 A * 7/1998 Yamashita et al. ..... 123/509
6,182,640 B1 * 2/2001 Nakashima et al. ..... 123/516
6,253,738 B1 * 7/2001 Takahashi et al. ..... 123/509
6,253,790 B1 * 7/2001 Hara ..... 137/565.17
6,357,424 B1 * 3/2002 Sonoda et al. ..... 123/509
6,378,504 B1 * 4/2002 Horiuchi et al. ..... 123/509
6,401,750 B2 * 6/2002 Tokunaga ..... 137/565.34
6,609,503 B1 * 8/2003 Nakagawa et al. ..... 123/509
6,655,363 B2 * 12/2003 Kobayashi et al. ..... 123/509
6,761,193 B1 * 7/2004 Cotton et al. ..... 141/98
2003/0102035 A1 * 6/2003 Dasilva et al. ..... 137/565.34

* cited by examiner

*Primary Examiner*—Thomas Moulis
(74) *Attorney, Agent, or Firm*—Reising, Ethington, Barnes, Kisselle, P.C.

(57) ABSTRACT

A cosmetically attractive fuel tank assembly preferably for a motorcycle application has a fuel pump subassembly inserted into the fuel chamber of the tank through bottom access hole thus preserving the overall appearance of the tank itself. The flange of the fuel pump subassembly covers the bottom access hole and sealably months to a bottom wall of the fuel tank. Various fuel pump subassembly components, such as a fuel pressure regulator, an outlet fuel filter, an electrical connector and a fuel outlet mount directly to the flange along with a tripod like vibration absorbing bracket which supports the fuel pump and preferably a fuel level sensor. The bracket is flexible and resiliently contacts an internal surface of a bottom wall of the fuel tank via a resilient pad, and is threadably engaged to the flange and spaced therefrom by a vibration damping member.

21 Claims, 5 Drawing Sheets

FUEL TANK ASSEMBLY

TECHNICAL FIELD

The present invention relates to a fuel tank assembly and more particularly to a fuel pump subassembly of the fuel tank assembly for a motorcycle.

BACKGROUND OF THE INVENTION

Large vehicles, such as the automobile, have a typically fuel injected engine and a fuel pump subassembly mounted inside a fuel tank. The fuel tank is generally hidden from view and mounted to the undercarriage of the vehicle. Various penetrations and protrusions, such as a tank access hole for insertion of the fuel pump subassembly into the tank, are typically located at the top of the tank to minimize any opportunity of fuel leakage. A top mounted flange supports the fuel pump subassembly and covers and seals the access hole. Location of the flange and various protrusions projecting outward from the flange at the top of the tank protects the flange from abusive road conditions. Because the tanks are concealed by the undercarriage of the vehicle, any negative cosmetic impact of the top mounted flange is of no consequence. Moreover, any noise produced by the fuel pump is likely not to disturb the vehicle occupants because of the remote location of the fuel tank and because of the vibration dampening and noise absorbing characteristics of the plastic used to manufacture the tank.

For smaller recreational vehicles such as motorcycles, industry trends are turning away from the typical gravity feed carburetors and are leaning toward the use of fuel injection systems similar to larger vehicles. Location of the fuel pump inside the relatively small tank of a motorcycle would be preferred because it could reduce the number of fuel hose and electrical connections and also decrease fuel vapor emissions and the chance of fuel leakage into the surrounding environment while providing a modular design which simplifies assembly and reduces manufacturing costs. Unfortunately, the introduction of a fuel pump subassembly inside the tank of such a small recreational vehicle is difficult because: the fuel tank is visually exposed and typically mounted near the top of the recreational vehicle making cosmetic appearance and thus the location of the pump subassembly flange a concern; the tank is relatively small making pump placement difficult; and the tank is typically made of metal which contributes to the proliferation of pump noise.

Because the fuel tank is visually exposed in a motorcycle application, the tank is traditionally decorated thus contributing to a cosmetic theme of the motorcycle. Often, the shape or general appearance of the tank is identifiable to a particular manufacturer, thus having trademark value, thus making cosmetic alterations for the addition of a fuel pump subassembly undesirable. Moreover, the operator of the recreational vehicle or motorcycle is often located directly adjacent to the fuel tank, hence, the tank is preferably smooth, having minimal protrusions which could potentially cause injury to the operator or rider. For example, the fuel tank of a motorcycle is disposed generally between the legs of the rider. Consequently, the tank is preferably "tear-drop" in shape having the larger globe portion positioned toward the front of the motorcycle while tapering off and sloping downward toward the motorcycle seat creating a substantially smooth transition between the tank and the seat. For motorcycle applications, the only protrusion which could typically come between the ergonomically friendly fuel tank and the rider is the fuel filler cap. However, the cap is relatively low and smooth in profile and is located toward the forward top of the tank at the larger globe portion of the "teardrop." The visually exposed placement of a flange, with associated fuel hoses and a wire harness, at the top of the fuel tank would not only crowd the filler cap, but would destroy the pleasing cosmetic appearance of the tank, expose the flange to possible damage and expose the rider to possible injury.

Moreover, the close proximity of the fuel tank to the rider makes the rider sensitive to noise emanating from the fuel tank. Because the motorcycle tank is traditionally made of steel, for strength and the adherence of paint, vibration induced noise caused by a running pump inside the tank is likely to be annoying to the rider. Furthermore, the running vibration characteristics of the motorcycle can be transmitted to the pump causing damage to pump components.

SUMMARY OF THE INVENTION

A cosmetically attractive fuel tank assembly preferably for a motorcycle application has a fuel pump subassembly inserted into the fuel chamber of the tank through a bottom access hole thus preserving the overall appearance, tradedress value and identifying characteristics of any specific manufacturer's tank. The flange of the fuel pump subassembly sealably covers the bottom access hole of the fuel tank. Various fuel pump subassembly components, such as a fuel pressure regulator, a fuel level sensor and an outlet fuel filter mount directly to the flange along with a tripod like bracket with three feet to support the fuel pump. The bracket is flexible and resiliently contacts an internal surface of a bottom wall of the fuel tank via a resilient pad which encases a rearward foot of the three feet. Preferably, the other two forward feet of the bracket engage threadably to the flange, yet are preferably spaced from the flange by respective vibration dampening members. Preferably, the fuel pump subassembly is preassembled prior to insertion into the tank through the access hole. The elongated shape of the subassembly and the relatively small size of the preferable motorcycle fuel tank requires that the fuel pump subassembly be rotated vertically within an imaginary plane until a rearward foot of a bridging portion of the bracket engages the internal surface, preferably at a bottom wall. As the flange seals to the bottom wall, a resilient bridging portion remains flexed and isolated from the flange and tank via the rearward pad and vibration dampening members.

Objects, features, and advantages of this invention include a fuel tank assembly for a fuel injected engine application which maintains traditional fuel tank exterior appearance, a reduction in fuel hose and electrical connections, a reduction in vibration amplitude prolonging the operational life of the fuel pump and reducing noise, and a more robust and module design simplifying manufacturing and reducing cost.

DESCRIPTION OF THE DRAWINGS

These and other objects, features and advantages of the invention will be apparent from the following detailed description, appended claims, and accompanying drawings wherein:

DETAIL DESCRIPTION OF THE PREFERRED EMBODIMENTS

Figure 1:
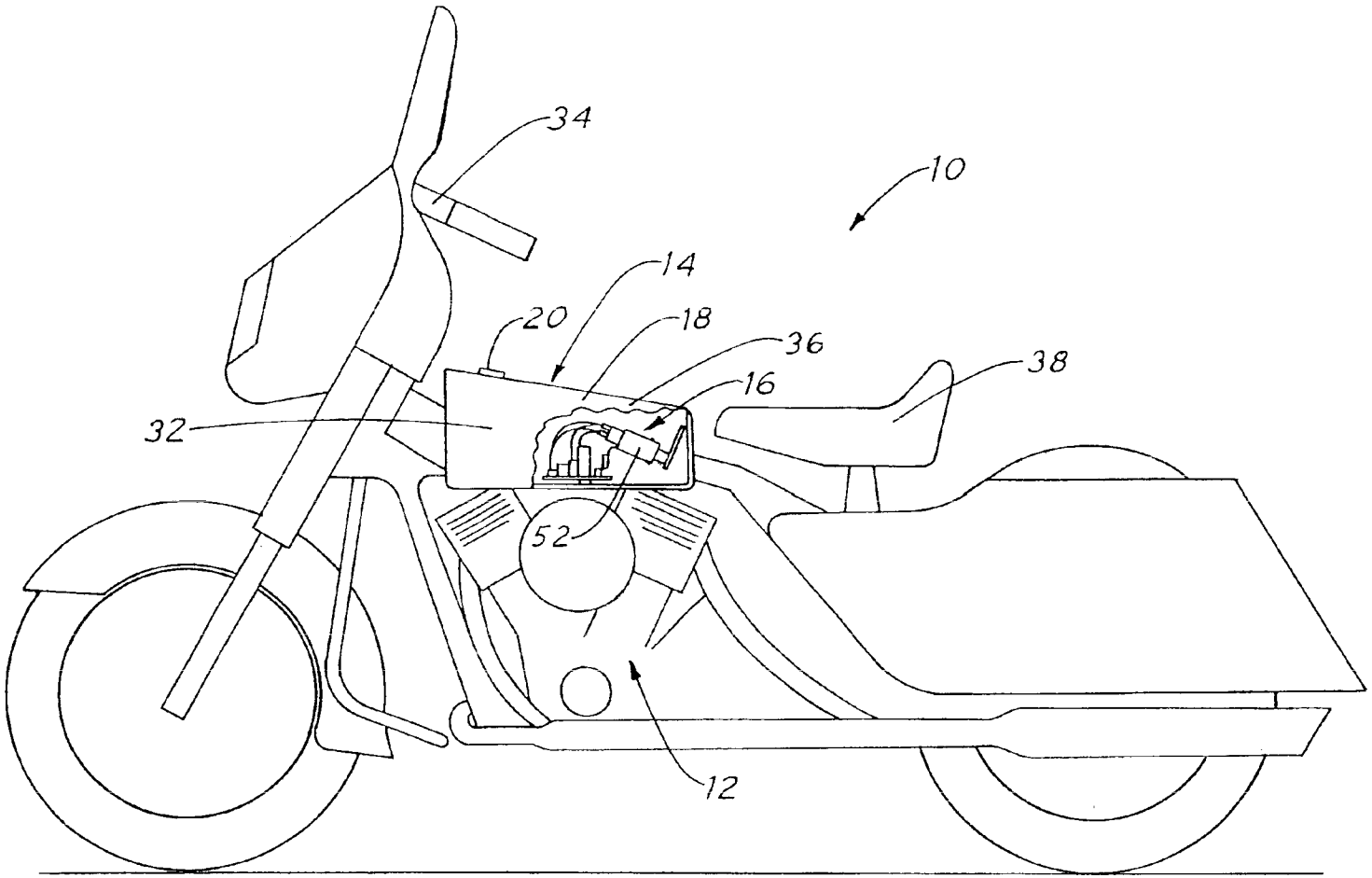
FIG. 1 is a perspective view of a motorcycle having a fuel tank assembly of the present invention with a portion of a fuel tank broken away to show internal detail.

Referring to FIG. 1, a motorcycle 10 has a fuel injected engine 12 which receives pressurized fuel from a cosmetically attractive fuel tank assembly 14. A fuel pump subassembly 16 of the fuel tank assembly 14 is conveniently concealed inside a fuel tank 18 of the assembly 14 thus preserving the aesthetic appearance, shape and any trademark value pre-established by the manufacturer. The only exposed or viewable component of the fuel tank 18 is a conventional top mounted filler cap 20, thus the tank 18 appears like a conventional fuel tank, however, the tank 18 of the present invention is not limited to flowing fuel via gravity to a combustion engine utilizing old carburetor technology.

Figure 2:
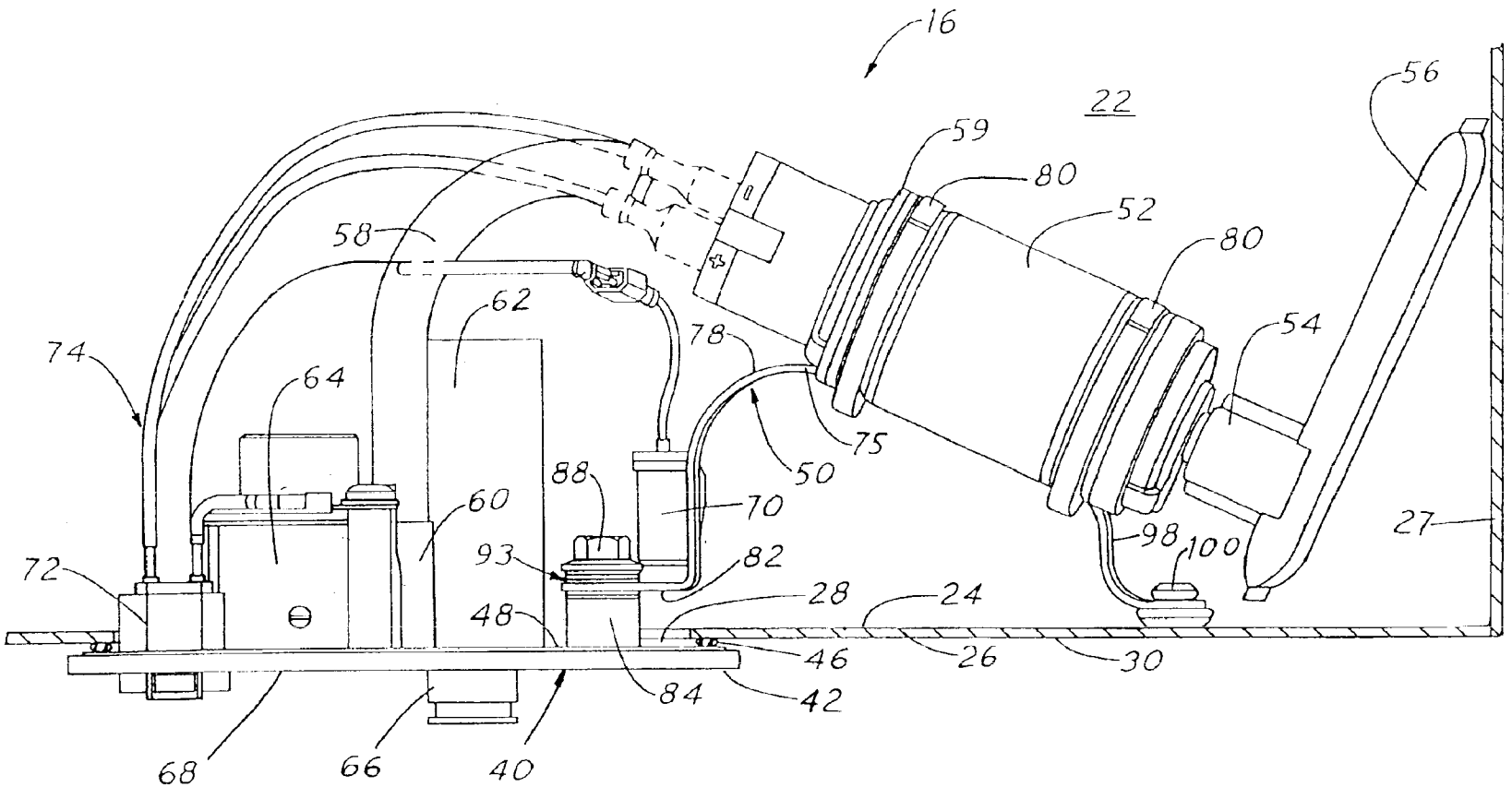
FIG. 2 is a perspective view of the fuel tank assembly with a portion broken away to show a fuel pump subassembly.
Figure 3:
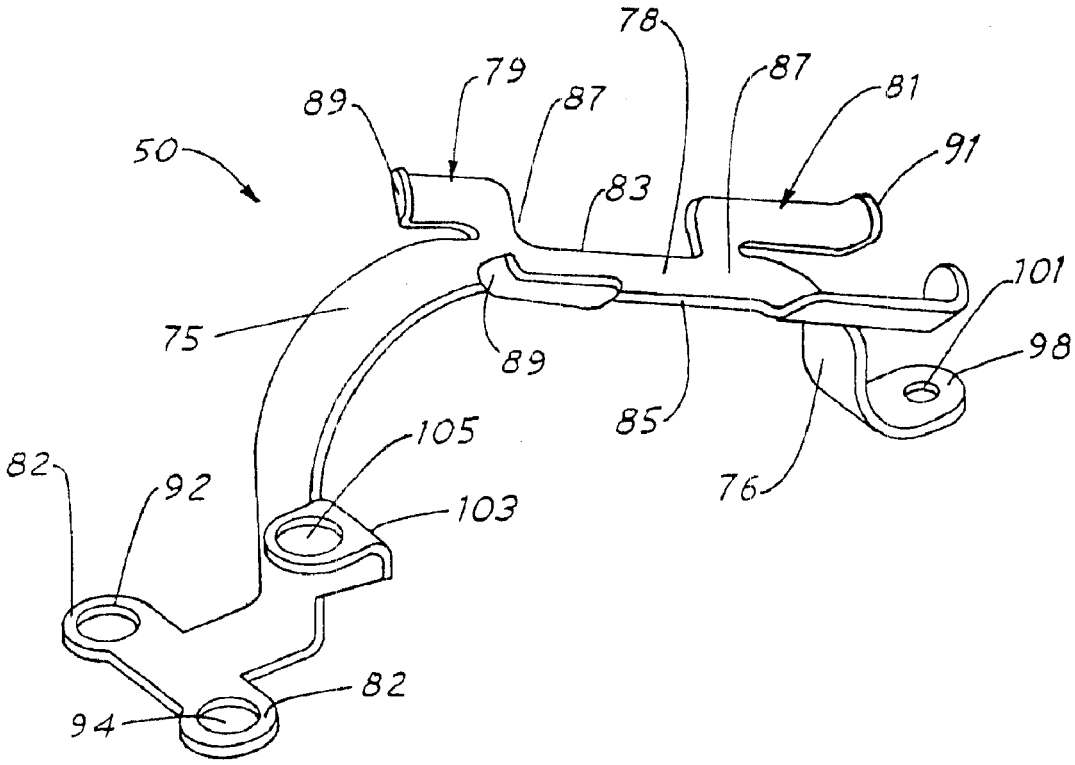
FIG. 3 is a perspective view of a bracket of the fuel pump subassembly.

Referring to FIGS. 1–3, the fuel tank 18 of the present invention is preferably made of metal for structural strength and superior paint adherence for cosmetic purposes. The fuel pump subassembly 16 is generally elongated in a non-linear fashion and shaped to fit within the relatively small confines of a fuel chamber 22 of the fuel tank 18 defined by an internal surface 24. A bottom wall 26 of the tank 18 carries in-part the internal surface 24 and defines a bottom access hole 28 through which the fuel pump subassembly 16 is inserted. An external surface 30 of the metal fuel tank 18 is preferably painted in any variety of colors and designs enhancing the visual cosmetic appearance.

The tank 18 is generally rounded or "tear-drop" shaped having a substantially global portion 32 disposed toward the handle bars 34 of the motorcycle 10 and a converging portion 36 which converges rearward toward a seat 38 of the motorcycle 10 providing a smooth transition between the tank 18 and the seat 38 for rider comfort.

Figure 4:
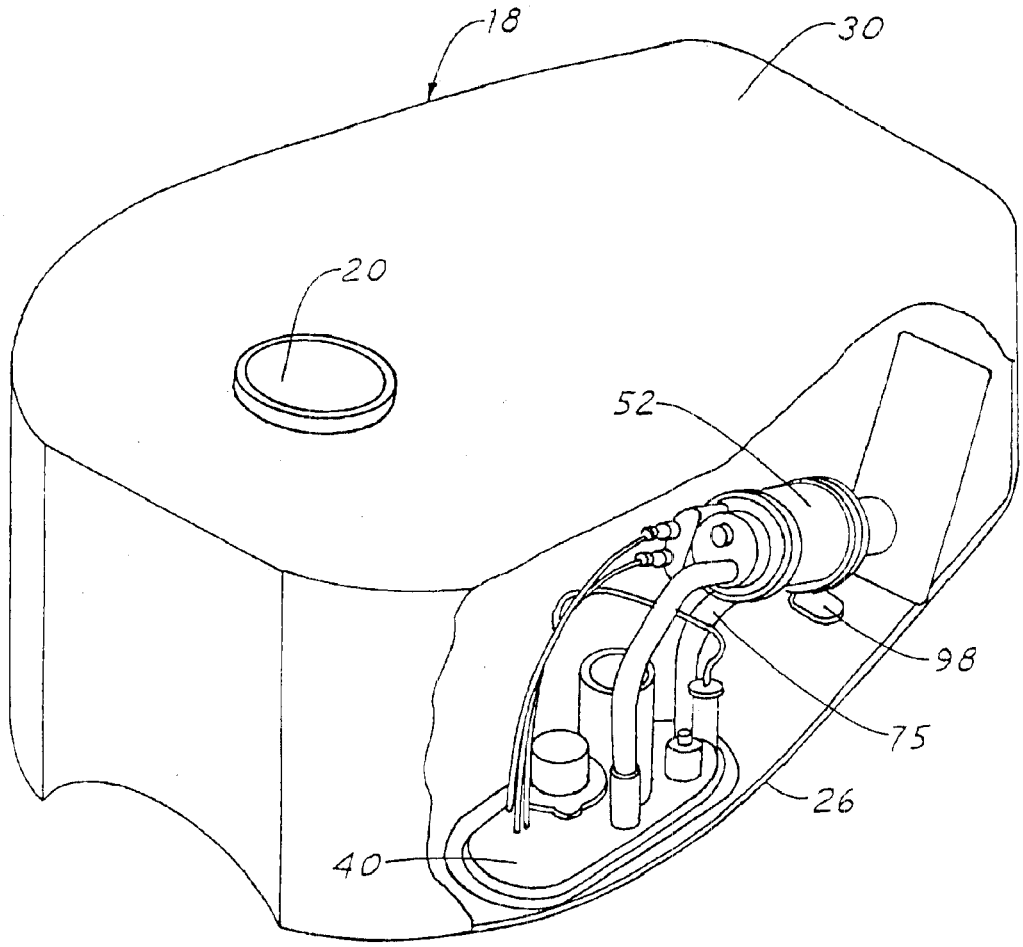
FIG. 4 is an enlarged perspective view of the fuel tank.
Figure 5:
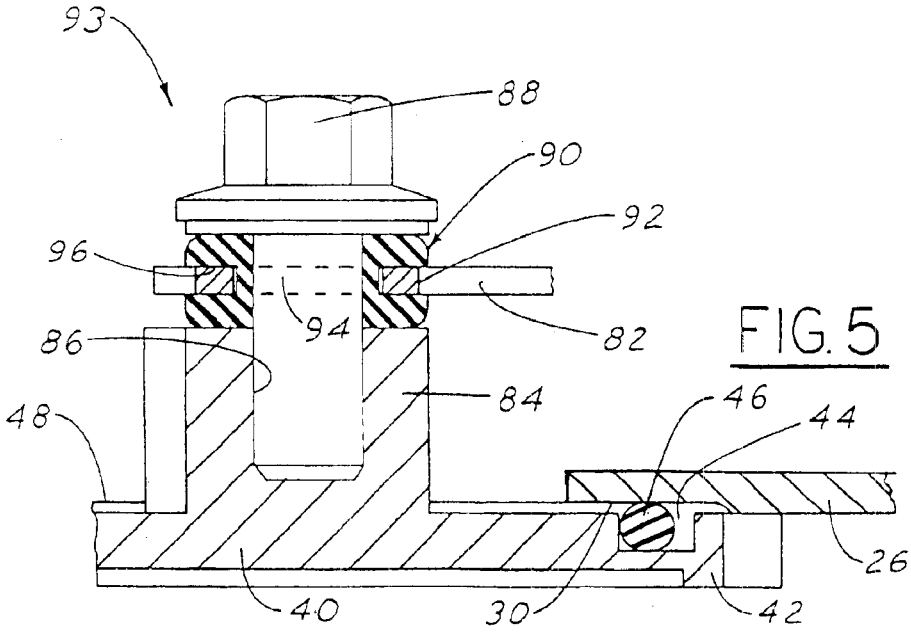
FIG. 5 is a cross section view of a vibration dampening connection of the fuel pump subassembly.

A substantially planar, and horizontally disposed, bottom support flange 40 of the fuel pump subassembly 16 has a peripheral edge 42 which carries a circumferentially extending and upward communicating groove 44 for seating a resilient O-ring 46 compressed against the external surface 30 of the bottom wall 26 at the global portion 32 of the tank 18 when assembled (as best shown is FIGS. 1 and 4). The O-ring 46 is fuel resistant and prevents the egress of fuel vapor, permeation, and/or gravity induced leakage of fuel out of the tank 18. Various fuel pump subassembly components project substantially upward from an interior face 48 of the flange 40 and into the fuel chamber 22. One of these components is a curved or arcuate bracket 50 which supports an elongated electric fuel pump 52 and projects generally from within the global portion 32 and into the converging portion 36 of the "tear-drop" tank 18. Because of the unique shape, low profile, and small volume of the fuel tank 18, the pump 52 is supported substantially horizontally along the top of the bracket 50 and is substantially disposed inside the converging portion 36 of the tank 18.

The fuel pump 52 of the fuel pump subassembly 16 has a rearward inlet 54 communicating with a bag-type fuel filter 56 capable of filtering out particles of approximately greater than thirty microns to protect the pump 52. The filter 56 generally touches the internal surface 24 of the tank 18 at the rearward-most region of the converging portion 36. This touching of the internal surface 24, which includes the bottom wall 26 and sidewalls 27, promotes the wetting or capillary action of the filter 56 for providing a constant supply of fuel to the pump inlet 54 even when portions of the filter 56 are not submerged in the liquid fuel. This partial exposure of the filter 56 to air is caused by excessive movement of fuel in a small tank, characteristic of recreational vehicles. Moreover, the filter 56 is conveniently located at the rear of the fuel tank 18 which is likely to see elevated levels of fuel during fast accelerations which is often characteristic of motorcycles 10.

The thirty micron filtered fuel flows out of the pump 52 in a super-atmospheric pressure condition via a fuel outlet or tube 58 disposed at a forward end 59 of the pump 52 opposite the inlet 54. The tube 58 projects generally forward from the pump 52 and downward to engage an upward unitarily projecting union 60 of the flange 40 which defines a channel (not shown) for flowing the fuel into an outlet filter 62. The outlet filter 62 projects unitarily upward from the interior face 48 of the flange 40 and filters approximately ten micron or greater particulate out of the super-atmospheric fuel to protect an upstream pressure regulator 64 of the fuel pump subassembly 16 and to protect the fuel injectors of the combustion engine 12. Similar to the outlet filter 62, the pressure regulator 64 projects upward from the bottom flange 40 and receives flowing fuel from the adjacent outlet filter 62 via a channel (not shown) integral to the flange. From the pressure regulator 64, fuel flows out of the tank 18 and through the bottom flange 40 via a nozzle or outlet 66 that projects unitarily downward from an exterior face 68 of the flange 40.

The bottom flange 40 also internally supports a fuel level sensor 70 via the bracket 50 and an integral electrical connector 72 which extends through the flange 40 and electrically connects to an internal wiring harness 74 for providing electric power to the fuel pump 52 and for carrying an electric signal from the fuel level sensor 70.

Referring to FIGS. 2 and 3, the bracket 50 is designed to resiliently support the fuel pump 52 within the fuel tank 18 and to isolate vibrations, or prevent transmittance of vibrations and noise, between the fuel tank 18 and the pump 52. This isolation reduces pump induced vibration which could otherwise be transmitted and magnified by the steel fuel tank 18 as noise thus creating an annoyance for the adjacent rider. Moreover, the bracket 50 reduces transfer of vibrations induced by the running engine 12 and transmitted through the fuel tank 18 thus prolonging the useful operating life of the fuel pump 52.

The arcuate bracket 50 is preferably made of a stamped low carbon steel for resiliency and strength, and is generally tripod-like having a resilient mid-bridging portion or elongated ban 75 which carries a concave profile formed by a bottom side 76 that faces generally downward toward the tank bottom wall 26. An opposite convex or top side 78 of the ban 75 substantially extends longitudinally with, and engages, the elongated pump 52 disposed above it. A pair of straps 80, preferably made of plastic, engage the pump 52 to the bracket 50 generally preventing lateral and upward movement of the pump 52 with respect to the bracket 50. Each strap 80 generally extends perpendicular to the ban 75 and wraps about the ban and the pump 52. The plastic straps 80 are spaced longitudinally apart from one another with respect to the steel ban 75 and pump 52 in order to secure circumferentially about each end of the pump 52.

A pair of forward fingers 79 prevent forward or longitudinal movement of the pump 52 with respect to the bracket 50, and a second pair of rearward fingers 81 prevent rearward movement. Each finger of each pair of fingers 79, 81 is cantilevered laterally outward from opposite edges 83, 85 of the ban 75. The lateral projection of each finger is bent slightly upward forming a generally concave saddle or seat 87 for each pair which conforms and seats to the cylindrical shape of the fuel pump 52. Each finger of the forward fingers 79 project longitudinally forward to an upward bent distal end 89 which catches the forward end of the pump 52 preventing forward pump movement. Likewise, each finger of the rearward fingers 81 project longitudinally rearward to an upward bent distal end 91 which catches the rearward end of the pump 52 preventing rearward pump movement.

Referring to FIGS. 2–5, a vibration absorbing connection 93 between the flange 40 and the bracket 50 utilizes a pair of forward feet 82 of the bracket 50 which project substantially forward from a forward end of the bracket ban 75. The feet 82 attach to respective stanchions 84 of the connection 93 that project unitarily upward from the interior face 48 of the preferably plastic flange 40. Each stanchion 84 has a threaded blind bore 86 which threadably receives a male fastener or bolt 88 to secure the respective foot 82 to the flange 40. A vibration damping member or grommet 90 spaces the foot 82 of the bracket 50 axially away from the stanchion 84, and radially and axially away from the male fastener 88. The grommet 90 is made of a resilient fuel resistant rubber-like material and can thus absorb vibrations transmitted to and from the fuel pump 52. Preferably, the grommet 90 is pre-mounted or press fitted into an over-sized bolt hole 94 defined by an inner edge 92 of each foot 82. When fully mounted, the circumferential edge 92 seats into a radially outwardly open circumferential groove 96 carried by the grommet 90.

Projecting rearward from an opposite end of the ban or bridging portion 75 is a third or rearward foot 98 which is engaged directly to a vibration absorbing pad or grommet 100. When the fuel tank assembly 14 is fully assembled, the steel bridging portion 75 is shaped to resiliently bias the rearward foot 98 and grommet 100 against the internal surface 24 of the bottom wall 26 to reduce vibration and eliminate resonating frequencies by eliminating any possibility of a clearance or space developing between the rearward foot 98 or grommet 100 and the bottom wall 26. Thus, with the resilient ban 75 placed under continuous stress, the foot 98 and grommet 100 are in continuous contact with the bottom wall 26 regardless of surrounding influences such as vibration and without the need for a fastening device or structure. Similar to the forward feet 82, the rearward foot 98 is spaced from the internal surface 24 by the resilient grommet 100 pressfitted into a hole 101 carried by the foot 98.

Referring to FIG. 3, a substantially horizontal shelf or sub-bracket 103 projects generally laterally outward from the edge 85 at a substantially vertical portion of the ban 75. The shelf has a hole 105 which receives and secures the fuel level sensor 70. Because the fuel level sensor 70 secures to the bracket 52 and not directly to the flange 40, the sensor 70 is not directly exposed to potentially harmful vibrations emanating from the combustion engine 12.

The fuel pump subassembly 16 is preferably pre-assembled prior to insertion into the fuel tank 18 through the bottom access hole 28. During insertion, the elongated fuel pump 52 is substantially positioned vertically. As the inlet filter 56, bracket 50 and fuel pump 52 are inserted through the access hole 28, the subassembly 16 is simultaneously rotated approximately ninety degrees so that the leading inlet filter 56 disposed toward the rear of the fuel pump subassembly 16 does not hit the close confines or internal surface 24 at the top of the tank 18. This insertion, and simultaneous rotation places the filter 56, bracket 50 and pump 52 into the close confines of the converging portion 36 of the tank 18. As the peripheral edge 42 of the flange 40 and O-ring 46 seal against the external surface 30 of the bottom wall 26, the grommet 100, which is pre-fitted to the rearward foot 98 of the bracket 50 presses resiliently against the internal surface 24 of the bottom wall 26, and the bridging portion 75 resiliently flexes assuring continuous contact between the grommet 100 and the tank 18 and assuring unobstructed sealing between the flange 40 and the tank 18.

Figure 6:
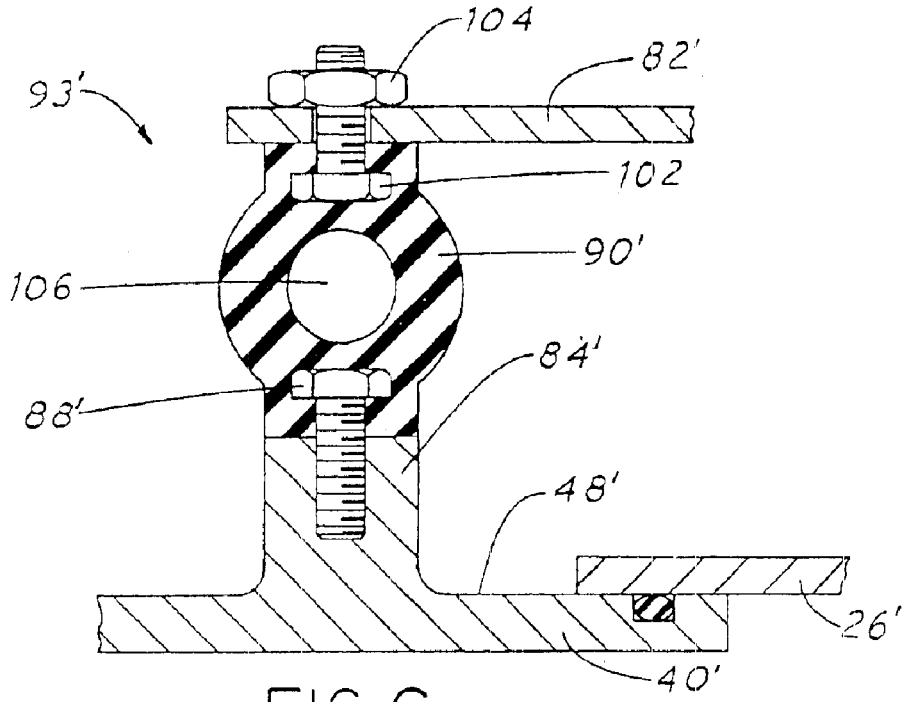
FIG. 6 is a cross section view of a second embodiment of a vibration dampening connection.

Referring to FIG. 6, a second embodiment of a connection 93' is illustrated. Connection 93' has a vibration absorbing member 90' which is similar to a resilient stanchion extension projecting upward. Member 90' is engaged between and spaces apart a forward foot 82' and a rigid flange stanchion 84'. A threaded fastener 88' has an enlarged head embedded into the vibration absorbing member 90' during the molding process of the rubber member, and threadably attaches to the stanchion 84' as a single part. Unlike the first embodiment, the member 90' of the connection 93' has a second embedded threaded fastener 102 which projects upward from the member 90' and extends through a hole 94' of the foot 82'. The fastener 102 and member 90' are secured to the foot 82' via a nut 104 engaged threadably to the fastener 102. Member 90' has a void 106 which promotes flexibility of the connection 81'. Because the fasteners 88', 102 are independent from one another, torquing of either threaded fastener 88', 102 during assembly will not effect the resiliency of the vibration absorbing member 90'.

Figure 7:
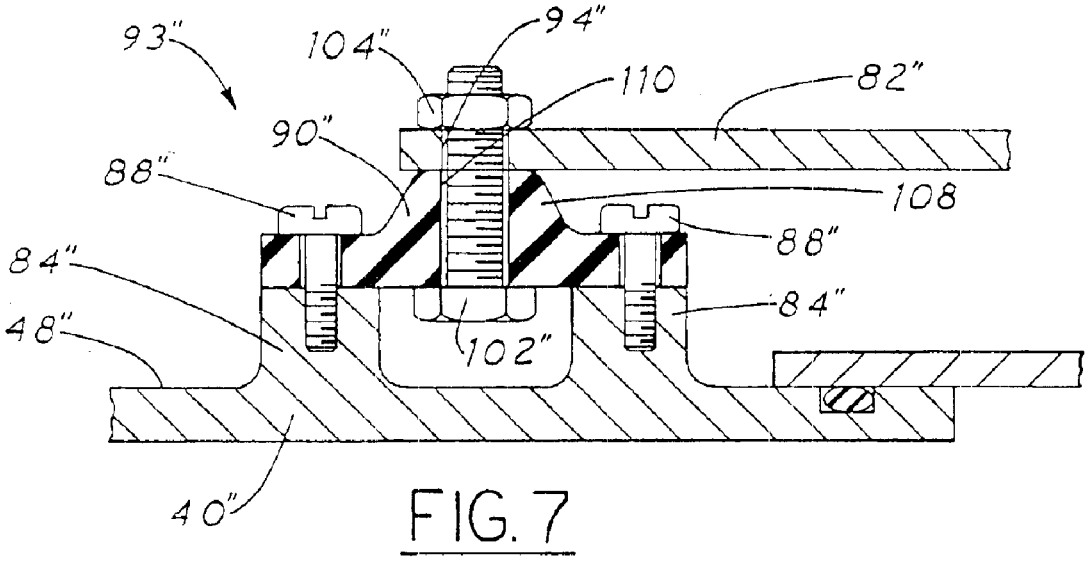
FIG. 7 is a cross section view of a third embodiment of a vibration damping connection.

Referring to FIG. 7, a third embodiment of a connection 93" is illustrated. Each connection 93" has two rigid stanchions 84" bridged by a vibration absorbing member 90" which is secured to each stanchion 84" by respective threaded bolts 88". A foot 82" is fastened directly to an upward projecting mound or prominence 108 having a hole 110 orientated concentrically below a hole 94" of the foot 82". A threaded fastener or bolt 102" extends through the holes 94", 110 and threads to a nut 104" orientated directly above the foot 82". Similar to the second embodiment, torquing down upon any one fastener during pre-assembly will not substantially effect the vibration absorbing characteristics of the member 90".

While the forms of the invention herein disclosed constitute presently preferred embodiments many others are possible, it is not intended here in to mention all of the possible equivalent forms or ramifications of the invention, it is understood that the terms used herein are merely descriptive rather than limiting and that various changes may be made without departing from the spirit or scope of the invention as defined by the following claims.

What is claimed is:

1. A fuel tank assembly for a combustion engine comprising:

a fuel tank having an internal surface, an external surface, a bottom wall defined between the internal and external surfaces, a fuel chamber defined by the internal surface, and a bottom access hole extending through the bottom wall to communicate with the fuel chamber;

a fuel pump subassembly substantially inserted into the fuel chamber through the bottom access hole, the fuel pump subassembly having a bottom flange engaged sealably to the bottom wall and covering the access hole, the fuel pump subassembly having a fuel pump carried by the bottom flange and disposed in the fuel chamber;

a fuel pressure regulator projecting upward from the flange and into the fuel chamber for receiving fuel from the fuel pump; and a fuel outlet nozzle extending downward through the flange for flowing fuel from the pressure regulator and out of the fuel chamber.

2. The fuel tank assembly set forth in claim 1 comprising a fuel filter projecting upward from the flange into the fuel chamber, and wherein the fuel filter filters fuel flowing from the fuel pump to the fuel regulator.

3. The fuel tank assembly set forth in claim 2 comprising a fuel level sensor of the fuel pump subassembly engaged to the bottom flange.

4. The fuel tank assembly set forth in claim 3 comprising an electric connector formed unitarily to the bottom flange and extending through the flange.

5. A fuel tank assembly for a combustion engine comprising:

a fuel tank having an internal surface, an external surface, a bottom wall defined between the internal and external surfaces, a fuel chamber defined by the internal surface, and a bottom access hole extending through the bottom wall to communicate with the fuel chamber;

a fuel pump subassembly substantially inserted into the fuel chamber through the bottom access hole, the fuel pump subassembly having a bottom flange engaged sealably to the bottom wall and covering the access hole, the fuel pump subassembly having a fuel pump carried by the bottom flange and disposed in the fuel chamber;

an elongated fuel pump bracket projecting longitudinally from the bottom flange and engaged to the fuel pump;

a first forward foot of the bracket; and a first vibration dampening member engaged directly between the bottom flange and the first foot of the bracket for isolating the bottom flange from the bracket and the fuel pump.

6. The fuel tank assembly set forth in claim 5 comprising:

an elongated bridging portion of the bracket projecting from the first foot and away from the flange; and wherein the fuel pump is engaged to the bridging portion.

7. A fuel tank assembly for a fuel injected combustion engine comprising:

a fuel tank having an internal surface, an external surface, a bottom wall defined between the internal and external surfaces, a fuel chamber defined by the internal surface, and a bottom access hole extending through the bottom wall to communicate with the fuel chamber;

a fuel pump subassembly substantially inserted into the fuel chamber through the bottom access hole, the fuel pump subassembly having a bottom flange engaged sealably to the bottom wall and covering the access hole, the fuel pump subassembly having a fuel pump carried by the bottom flange and disposed in the fuel chamber;

an elongated fuel pump bracket projecting longitudinally from the bottom flange and engaged to the fuel pump;

a first forward foot of the bracket;

a first vibration dampening member engaged directly between the bottom flange and the first foot of the bracket for isolating the bottom flange from the bracket and the fuel pump;

an elongated bridging portion of the bracket projecting from the first foot and away from the flange;

wherein the fuel pump is engaged to the bridging portion;

a rearward foot of the bracket biased against the internal surface of the fuel tank; and wherein the bridging portion is flexible and extends resiliently between the first forward foot and the rearward foot.

8. The fuel tank assembly set forth in claim 7 comprising:

a vibration dampening pad engaged to the rearward foot; and wherein the dampening pad is compressed resiliently between the rearward foot and the internal surface by the bridging portion.

9. The fuel tank assembly set forth in claim 8 wherein the dampening pad engages the internal surface at the bottom wall of the fuel tank.

10. The fuel tank assembly set forth in claim 5 comprising:

a second forward foot of the bracket; and a second vibration dampening member engaged directly between the bottom flange and the first foot of the bracket for isolating the bottom flange from the bracket and the fuel pump.

11. The fuel tank assembly set forth in claim 9 comprising:

a second forward foot of the bracket; and a second vibration dampening member engaged directly between the bottom flange and the first foot of the bracket for isolating the bottom flange from the bracket and the fuel pump.

12. The fuel tank assembly set forth in claim 5 wherein the vibration dampening member is a fuel resistant rubber grommet.

13. A fuel tank assembly for a fuel injected combustion engine comprising:

a fuel tank having an internal surface, an external surface, a bottom wall defined between the internal and external surfaces, a fuel chamber defined by the internal surface, and a bottom access hole extending through the bottom wall to communicate with the fuel chamber;

a fuel pump subassembly substantially inserted into the fuel chamber through the bottom access hole, the fuel pump subassembly having a bottom flange engaged sealably to the bottom wall and covering the access hole, the fuel pump subassembly having a fuel pump carried by the bottom flange and disposed in the fuel chamber;

an elongated fuel pump bracket projecting longitudinally from the bottom flange and engaged to the fuel pump;

a first forward foot of the bracket;

a first vibration dampening member engaged directly between the bottom flange and the first foot of the bracket for isolating the bottom flange from the bracket and the fuel pump;

wherein the vibration dampening member is a fuel resistant rubber grommet;

a stanchion projecting upward from the bottom flange, the stanchion having a threaded blind bore;

the first foot of the bracket having an inner circumferential edge defining a hole;

the grommet having a circumferential groove opening radially outward;

wherein the grommet extends through the hole and the circumferential edge seats in the circumferential groove;

a male fastener threaded into the blind bore and extending upward concentrically through the grommet to secure the leg of the bracket to the flange; and wherein the first foot does not directly engage the flange.

14. A fuel tank assembly for a combustion engine comprising:

a fuel tank having an internal surface, an external surface, a bottom wall defined between the internal and external surfaces, a fuel chamber defined by the internal surface, and a bottom access hole extending through the bottom wall to communicate with the fuel chamber;

a fuel pump subassembly substantially inserted into the fuel chamber through the bottom access hole, the fuel pump subassembly having a bottom flange engaged sealably to the bottom wall and covering the access hole, the fuel pump subassembly having a fuel pump carried by the bottom flange and disposed in the fuel chamber;

wherein the fuel tank is a motorcycle fuel tank being of a tear-drop shape and having a forward global portion, having a top mounted fuel filler cap and a rearward portion which converges in a rearward direction; and the fuel pump subassembly projecting in a rearward direction and into the rearward portion from the bottom flange.

15. The fuel tank assembly set forth in claim 14 comprising a bag-type inlet fuel filter being in contact with the internal surface of the fuel tank at the bottom wall and a side wall of the fuel tank.

16. The fuel tank assembly set forth in claim 9 wherein the bridging portion is an arcuate band having a concave bottom side facing downward and an opposite top side engaged to the fuel pump.

17. The fuel tank assembly set forth in claim 9 wherein a sub-bracket is engaged to the bridging portion for supporting a fuel level sensor of the fuel pump subassembly.

18. The fuel tank assembly set forth in claim 16 comprising:

a strap wrapped about the fuel pump and the band of the bracket;

a first finger projecting forward from the band, the first finger having an upward bent distal end for engaging a forward end of the fuel pump; and a second finger projecting rearward from the band, the second finger having an upward bent distal end for engaging a rearward end of the fuel pump.

19. A method of manufacturing a fuel tank assembly for a fuel injected combustion engine, the method comprising the steps of:

assembling a fuel pump subassembly having a bottom flange, a bracket engaged upward from the bottom flange, and a fuel pump engaged to the bracket;

inserting the fuel pump subassembly upward through a bottom access hole of a fuel tank;

contacting a rearward foot of the bracket against an internal surface of the fuel tank;

flexing the bracket;

covering the access hole of the fuel tank with the bottom flange; and sealing the flange to an external surface of the fuel tank while the bracket remains flexed.

20. The method of manufacturing set forth in claim 19 comprising the further step of rotating the fuel pump subassembly in an imaginary generally vertical plane, simultaneous to the step of inserting the fuel pump subassembly, so that the rearward foot contacts the internal surface at a bottom wall of the fuel tank.

21. A fuel tank assembly for a combustion engine of a vehicle having forward movement, the fuel tank assembly comprising:

a fuel tank defining a fuel chamber, the fuel tank having a bottom wall defining in part the fuel chamber, a bottom access hole extending through the bottom wall to communicate with the fuel chamber, and a rear portion with respect to vehicle movement;

a fuel pump subassembly substantially inserted into the fuel chamber through the bottom access hole, the fuel pump subassembly having a bottom flange engaged sealably to the bottom wall and covering the access hole;

an elongated fuel pump of the subassembly having a fuel inlet at a distal end; and an arcuate and elongated fuel pump bracket of the subassembly projecting upward and rearward from the bottom flange, the elongated fuel pump being supported by and co-aligned longitudinally with the bracket in a substantially horizontal position with the distal end of the pump positioned furthest from the flange in a rearward direction for locating the fuel inlet in the rear portion which experiences fuel level swells during acceleration of the vehicle.

* * * * *